United States Patent [19]

MacBeth

[11] 4,288,772

[45] Sep. 8, 1981

[54] DIELECTRIC LIQUID IMPREGNATED WITH GASES FOR USE IN TRANSFORMERS

[75] Inventor: Ian H. MacBeth, Egremont, Mass.

[73] Assignee: General Electric Company, N.Y.

[21] Appl. No.: 127,686

[22] Filed: Mar. 6, 1980

Related U.S. Application Data

[63] Continuation of Ser. No. 969,246, Dec. 13, 1978, abandoned.

[51] Int. Cl.[3] ..... H01F 27/10; H01B 3/20

[52] U.S. Cl. ..... 336/58; 174/15 R; 252/571; 252/573; 252/574; 336/94; 585/6.3

[58] Field of Search ..... 252/63, 63.5, 63.7, 252/66, 571, 573, 574; 336/58, 94; 174/15 R; 585/6.3

[56] References Cited

U.S. PATENT DOCUMENTS

| | | | |
|---|---|---|---|
| 2,416,130 | 2/1947 | Treanor | 336/94 X |
| 2,433,729 | 12/1947 | Bennett | 252/66 X |
| 2,912,382 | 11/1959 | Liao et al. | 252/63.7 X |
| 3,184,533 | 5/1965 | Eiseman | 252/63.5 X |
| 3,335,343 | 8/1967 | Moore et al. | 252/63 X |
| 3,444,308 | 5/1969 | Narbut | 336/58 X |
| 3,673,093 | 6/1972 | Rocchi | 252/63 X |
| 4,146,491 | 3/1979 | Vincent | 252/63.7 |

*Primary Examiner*—P. E. Willis, Jr.
*Attorney, Agent, or Firm*—Richard A. Menelly

[57] ABSTRACT

A flame retardant dielectric coolant for power transformers used in restricted environments consisting of a mixture of an electronegative gas dissolved in silicone fluid for providing improved 60 hertz breakdown voltage resistance to the fluid.

2 Claims, 4 Drawing Figures

DIELECTRIC LIQUID IMPREGNATED WITH GASES FOR USE IN TRANSFORMERS

This is a continuation of Ser. No. 969,246 filed Dec. 13, 1978 now abandoned.

BACKGROUND OF THE INVENTION

This invention relates to transformers in general, and particularly those type transformers employing flame retardant dielectric liquids. With the advent of recent Environmental Protection Agency banns on the use of chlorinated biphenals in transformer dielectric fluids, development programs have been undertaken on effective substitutes.

One effective substitute comprises a Silicone based oil as a dielectric coolant within those transformers used in restricted environments wherein the transformer dielectric must be relatively nonflammable. Examples of such transformers are applications in locomotive propulsion systems, electrostatic precipitative systems, and other applications within or close to habitable structures.

The use of Silicone oil in locomotive transformers requires a larger transformer housing to provide effective dielectric properties to the transformer while maintaining reliable core and coil thermal dissipation. The reason for the larger quantity of Silicone oil is the somewhat poorer thermal transfer properties apparent with the Silicone. Since Silicone oil is relatively expensive some means must be employed to increase the thermal and dielectric properties of the Silicone so that a reduced quantity can be employed without decreasing the transformer insulation.

SUMMARY OF THE INVENTION

The invention comprises a transformer dielectric coolant with improved dielectric properties consisting of a relatively nonflammable liquid containing therein a quantity of a soluble gas having dielectric properties. In one embodiment the liquid comprises Silicone oil and the dissolved gas consists of several percent by volume of an electronegative gas. A further embodiment comprises a high molecular weight liquid hydrocarbon containing a quantity of dissolved sulfur hexaflouride gas.

GENERAL DESCRIPTION OF THE INVENTION

Figure 1:
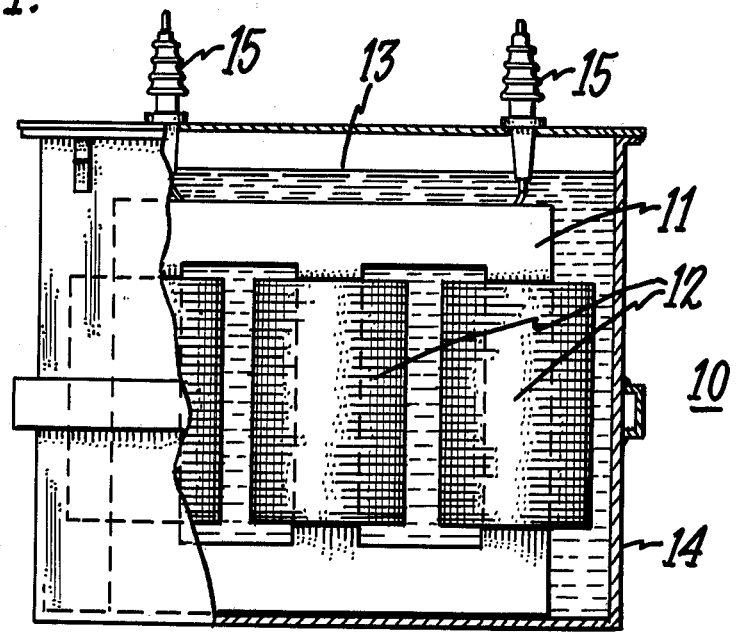
FIG. 1 is a side view in partial section of a transformer containing the dielectric coolant mixture according to the invention.

FIG. 1 shows a transformer 10 of the type containing at least one core 11 and a winding arrangement 12 situated within a filling of a dielectric coolant 13 and usually contained within a transformer casing 14 wherein electrical continuity is provided by means of at least one feedthrough bushing 15. The purpose of dielectric coolant 13 is to prevent short circuit occurrence between the windings as well as between other elements within the casing. A further purpose for dielectric coolant 13 is to dissipate the heat created within the core and the windings by the convection of molecules of the dielectric coolant from the core and winding to the transformer casing.

Figure 2:
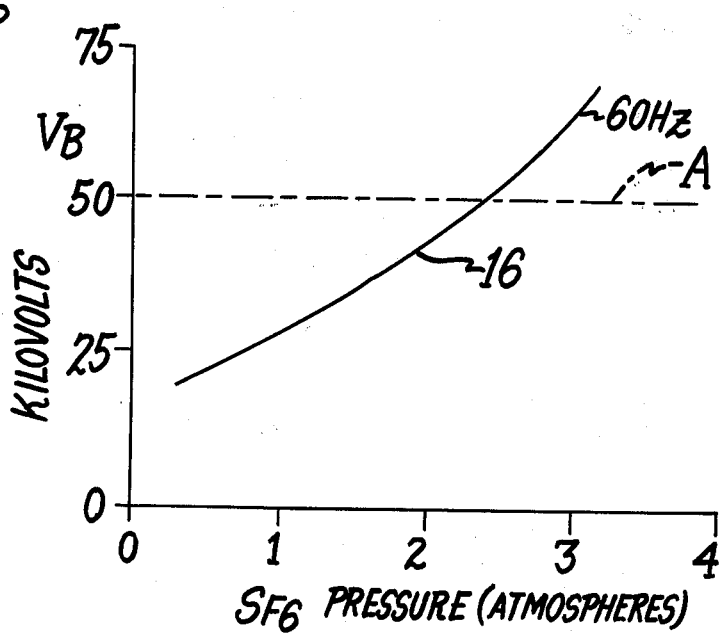
FIG. 2 is a graphic representation of the breakdown voltage at 60 hertz as a function of dielectric gas pressure.
Figure 3:
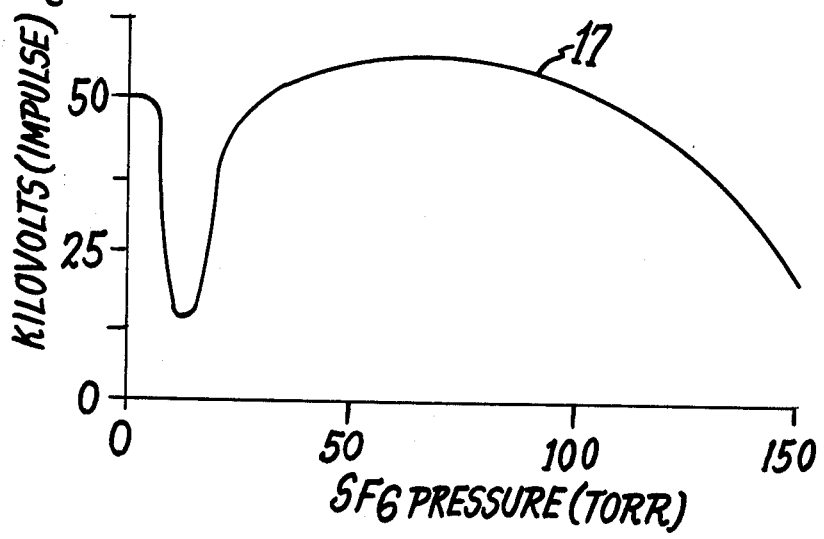
FIG. 3 is a graphic representation of the published relationship between breakdown voltage under impulse conditions as a function of quantity of dielectric gas dissolved in standard transformer oil.

FIG. 2 shows the breakdown voltage under test conditions when an electronegative gas such as sulfur hexaflouride ($SF_6$) is used as in dielectric. The breakdown voltage 16 under 60 hertz excitation is shown to continuously increase as the $SF_6$ pressure is increased. The use of $SF_6$ as a dielectric medium within transformers, per se, is discouraged because of the high pressure gas rates involved and the poor thermal transfer properties of the $SF_6$ gas. For comparison purposes a 60 hertz breakdown voltage for Silicone oil dielectric is shown at A, and it is to be noted that a substantial pressure of $SF_6$ must be employed to reach the equivalent dielectric strength of the Silicone oil. A published relationship 17 is shown in FIG. 3, for the breakdown voltage of standard transformer oil. It is to be noted that for low gas pressures, and hence low concentrations, the impulse breakdown voltage is substantially reduced below that of the transformer oil itself and for larger concentrations the impulse breakdown voltage increases to a value greater than that for the oil itself. The use of a dielectric gas in combination with a transformer liquid coolant has heretofore been discouraged by the occurrence of the very low impulse breakdown voltage which occurs when a low concentration of gas is realized.

This invention provides a dielectric coolant mixture containing a relatively nonflammable dielectric liquid to which a dielectric gas has been added for the purpose of improving the overall dielectric properties of the mixture. The combination of the dielectric liquid coolant and the dissolved dielectric gas also increases the temperature at which the mixture will burn.

DESCRIPTION OF THE PREFERRED EMBODIMENT

Figure 4:
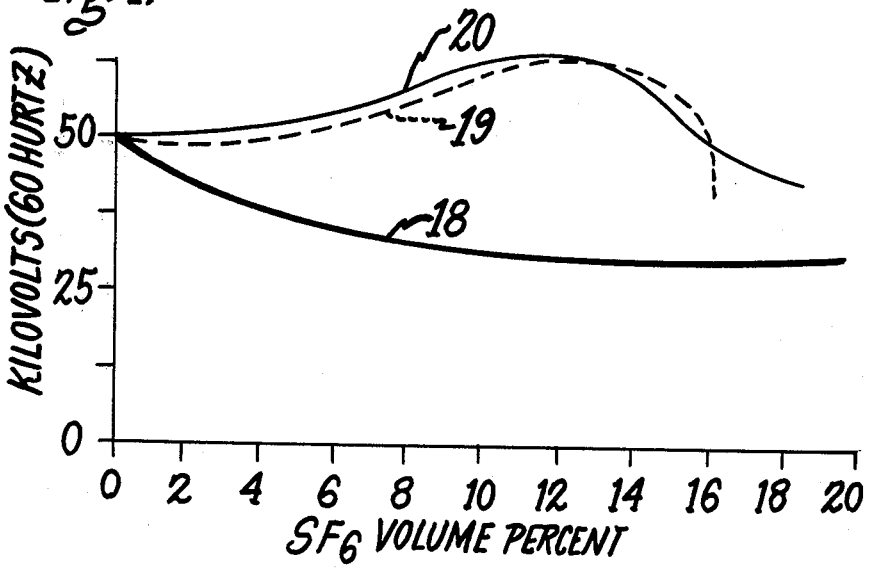
FIG. 4 is a graphic representation of the variation in breakdown voltage under 60 cycle conditions as a function of the quantity of dissolved dielectric gas in the electric coolant mixture according to the invention.

The prior art teaching of the discontinuity in breakdown voltage occuring with dielectric liquid and gas mixtures shown earlier in FIG. 3, has heretofore discouraged the use of $SF_6$ gas as an additive to the liquid coolant in dielectric cooling systems. However, testing various liquids of dielectric natures under different voltage conditions revealed the fact that these liquids react substantially differently under 60 hertz voltage conditions than when subjected to impulse voltage conditions. The relationship between 60 hertz breakdown voltage and gas concentration is shown in FIG. 4 wherein a quantity of Silicone oil was tested for breakdown voltage at 60 hertz under a variety of test conditions. It was then determined that the 60 hertz breakdown voltage is such a sensitive function of dissolved impurity gases in that the presence of even a small quantity of dissolved air, as shown at 18, can substantially affect the 60 hertz breakdown properties of the Silicone fluid. An attempt to presaturate the Silicone fluid with a pure insulating gas to prevent the absorption of the air resulted in the further discovery that the 60 hertz breakdown voltage continuously increases with dielectric gas concentration and reaches a maximum breakdown voltage within a predetermined gas percentage range. The relationship between 60 hertz breakdown voltage and the addition of a chlorinated fluorocarbon, such as Freon 112 (a tradename of the Dupont Chemical Company), to Silicone fluid is shown at 19 and can be seen to have very little effect on 60 hertz breakdown voltage when only a few percent are dissolved, but causes the breakdown voltage to increase approximately 30 percent when concentrations in excess of 10 percent are realized. An effective range of concentration would be from 5 to 15 percent for increasing breakdown voltage wherein further increases beyond 15 percent returns the breakdown voltage to that of pure Silicone fluid. The addition of an electronegative gas, such as $SF_6$, is shown at 20 to experience approximately the same increase in breakdown voltage when added to pure outgassed Silicone fluid by standard gas metering techniques.

FIG. 4, therefore shows that electronegative gasses such as $SF_6$ and chlorinated fluorocarbons within prescribed concentrations, substantially improve the 60 hertz breakdown characteristics of polysiloxane transformer dielectric coolants such as Silicone. The presence of the dissolved gasses did not adversley effect any of the other required insulating properties of the system. The thermal transfer characteristics of the mixture remain essentially the same since the volume actually occupied by the dissolved gas is negligible. There is some indication that the flash point, which is measured as one indication of the flame retarding properties of the Silicone, is actually enhanced. The improved flame retardation property is not at this time understood but is presumed to be related to the combustion retarding properties inherent with halogen compounds. Although sulfur hexafluoride is disclosed herein, it is to be understood that other halogen containing fluids such as dicarbon hexafluoride in both gas and liquid form, can be added to the Silicone coolant system for the purpose of flame retardation and dielectric improvement. It is further noted that electronegative and chlorinated fluorocarbon fluids can be added to flame-retardent high-molecular weight nonflammable hydrocarbons such as dodecyl benzene ($C_6H_5C_{12}H_{25}$) having an average molecular weight in excess of two hundred.

The use of the dielectric coolant mixture of dissolved $SF_6$ in Silicone fluid is particularly advantageous in transformers used within locomotive propulsion systems. The increase in the dielectric capability of the dielectric coolant mixture can result in a decrease in the amount of cellulosic dielectric insulation required between the windings and the transformer casing. The decrease in the amount of the dielectric insulation causes a corresponding beneficial decrease in the amount of water generated by the insulating materials over the operating life of the transformer. Transformers of the type containing flame retardant dielectric liquids are most often employed in systems that are protected from impulse voltages by means of external voltage surge arresters. Problems inherent in prior art teachings of low impulse breakdown voltages are thereby avoided by the additional impulse protection provided.

Although the dielectric coolant mixture of the invention is disclosed for locomotive type transformers this is by way of example only. The dielectric coolant mixture of the invention finds application wherever a dielectric coolant is to be employed in any type electrical apparatus.

What is claimed as new and which it is desired to secure by Letters Patent of the United States is:

1. A transformer having improved 60 Hertz voltage breakdown characteristics comprising:
   - a transformer casing including at least one core and at least one winding arranged around the core; and
   - a quantity of silicone fluid within the casing for insulating and cooling the core and winding, with five to twenty-five percent by volume of sulfur hexafluoride gas for improving the 60 Hertz voltage breakdown properties of the silicone fluid.

2. A method for increasing the 60 Hertz breakdown voltage in transformers containing a silicone fluid dielectric liquid comprising the steps of:
   - adding from five to twenty-five percent by volume of the material selected from the group consisting of sulfur hexafluoride and dicarbon hexafluoride gas to said silicone fluid dielectric liquid.

* * * * *